United States Patent [19]

Dietrich

[11] Patent Number: 4,809,388

[45] Date of Patent: Mar. 7, 1989

[54] PORTABLE SURFACE TREATING APPARATUS WITH NON-STRAIGHT HANDLE

[75] Inventor: Richard J. Dietrich, Valley City, N. Dak.

[73] Assignee: Dietrich & Sons, Incorporated, Valley City, N. Dak.

[21] Appl. No.: 156,760

[22] Filed: Feb. 18, 1988

[51] Int. Cl.[4] ..... A46B 5/00

[52] U.S. Cl. ..... 15/143 R; 15/160

[58] Field of Search ..... 15/143 R, 143 A, 143 B, 15/144 R, 144 A, 144 B, 145, 146, 147 R, 159 R, 160, DIG.10; 16/110 R

[56] References Cited

U.S. PATENT DOCUMENTS 1,587,369 6/1926 Flowers ..... 15/143 R 2,753,579 7/1956 Kussmann ..... 15/145

*Primary Examiner*—Peter Feldman

*Attorney, Agent, or Firm*—Wood, Dalton, Phillips, Mason & Rowe

[57] ABSTRACT

A portable surface treating apparatus is provided and has a head with means for treating a surface against which the head is swept, a non-straight elongate handle with spaced ends, structure for connecting one handle end to the head, and structure at the other end of the handle to be grasped by a user to facilitate manipulation of the head from a location remote from the head.

2 Claims, 1 Drawing Sheet

FIG. 1
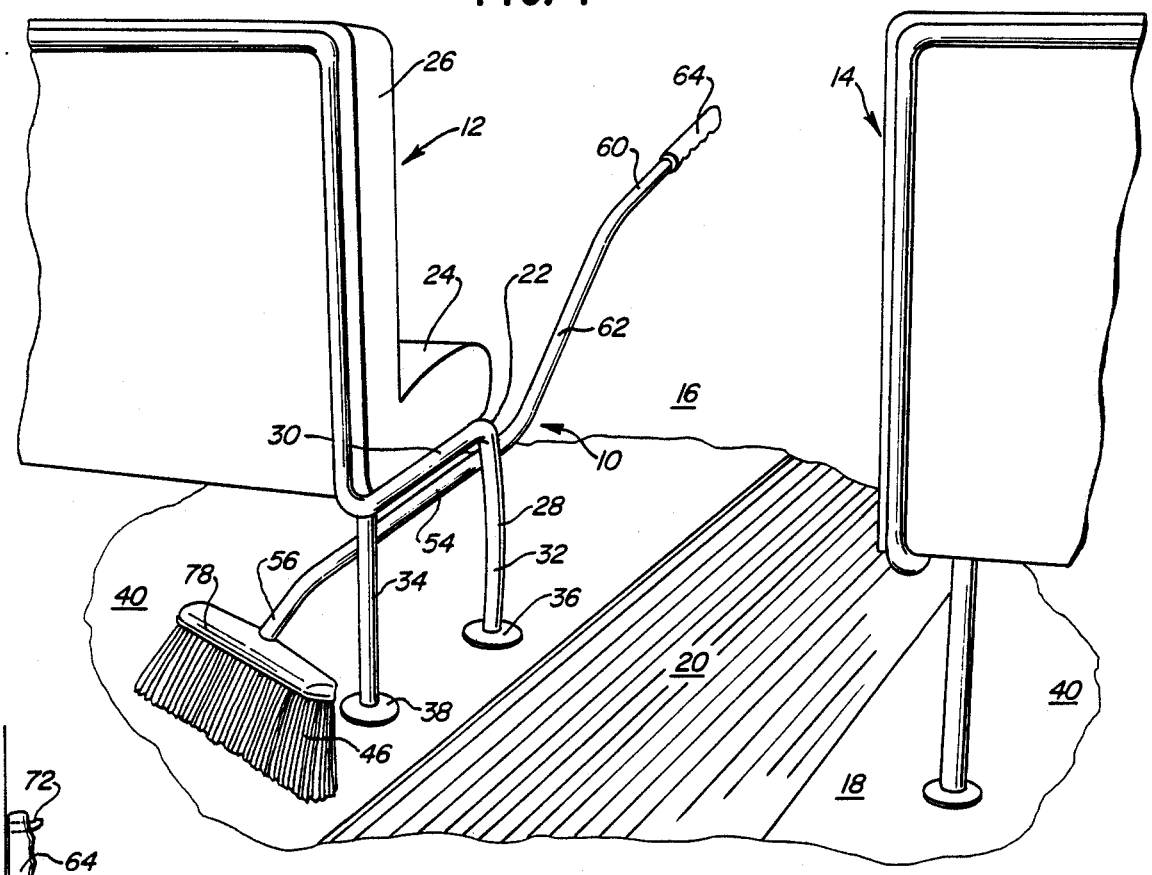
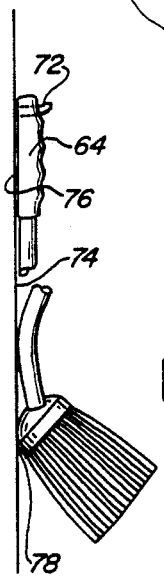
FIG. 3
FIG. 2
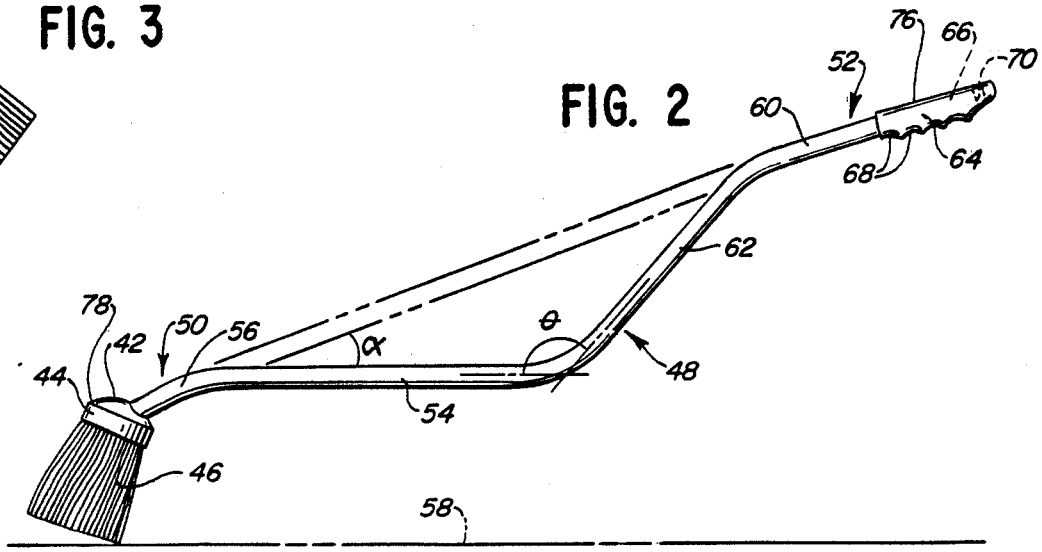

PORTABLE SURFACE TREATING APPARATUS WITH NON-STRAIGHT HANDLE

BACKGROUND OF THE INVENTION

1. Field of the Invention

This invention relates to portable surface treating apparatus such as brooms and, more particularly, to an apparatus with a non-straight handle to facilitate access to surfaces beneath chairs, benches, and the like.

2. Background Art

Brooms and other like portable surface treating apparatus are conventionally constructed with a surface treating head and a straight, elongate handle attached to the head to facilitate manipulation of the head at a location remote therefrom. One type of broom has bound bristles generally aligned with the length of the handle. Another type of conventional broom has a block with attached flexible bristles. The handle is connected to the block at an angle that, with the head in a preferred orientation for treating a surface, causes the handle to be oriented for comfortable control by the user. Both of the above conventional designs have proven adequate for sweeping uninterrupted floor space.

The above broom configurations, however, do not lend themselves to convenient treatment of surfaces under objects, such as chairs, shelves and the like. For example, if one desires to use a broom with a straight handle to sweep under a chair, the user must substantially reduce the angle that the handle makes with the chair supporting surface to facilitate passage of the broom under the chair seat. This necessitates the user's leaning down and reaching under the chair at an awkward angle. This tends to strain the user's back and causes muscular fatigue.

Additionally, to reach surfaces under chairs, and the like, the broom must generally be oriented so that the bristles are not at a preferred angle with respect to the surface that is being treated. As a result the user must normally apply downward pressure on the handle in the vicinity of the bristles as the head is swept against the surface to compensate for the undesirable attitude of the head. This requires the user's reaching under the chair or other structure under which the surface is being cleaned. The user's hand in the process will frequently encounter the structure under which the cleaning is carried out and the result may be skinned and/or bruised hands.

Even with special effort made to hold the bristles firmly against the surface to be treated, it is inevitable that with a conventional structure there will be places such as corners that will be inadequately treated.

SUMMARY OF THE INVENTION

The present invention is specifically directed to overcoming the above enumerated problems in a novel and simple manner.

According to the invention, a portable surface treating apparatus is provided and has a head with means for treating a surface against which the head is swept, a non-straight elongate handle with spaced ends, structure for connecting one handle end to the head, and structure at the other end of the handle to be grasped by a user to facilitate manipulation of the head from a location remote from the head.

In a preferred form, the handle has a straight section which is connected to the head so that with the head in a preferred treating orientation with respect to a flat, upwardly facing surface, the first section is substantially horizontal. The treating structure on the head is at least partially below the line of the first straight section and the structure to be grasped is above the line of the first straight section.

With the inventive structure, a preferred orientation of the head can be maintained, regardless of whether the treating apparatus is used to clean an uninterrupted flat surface or under elevated structure such as a chair seat. The handle, in effect, goes around the otherwise interfering structure without any accommodation required by the user, as by changing the angle the handle makes with the surface to be treated.

Preferably, the end of the handle which is grasped has a second straight section with a surrounding grip. This facilitates holding by the user. The second section may be parallel to or make an acute angle with the first straight section depending upon the desired hand orientation with the apparatus being held by a user.

In one form, the head has a plurality of bristles and is connected to an offset on the first straight handle section, with the angle of the offset determined by the preferred orientation of the bristles.

Another object of the invention is to provide a device that can be easily placed in a storage position. The grip on the second handle section is preferably resilient and has a flat surface which is in alignment with a supporting edge on the head. Structure is formed integrally with the grip to facilitate attachment to a hanger on a vertically extending surface. In a storage position, the flat surface of the grip and the supporting edge on the head simultaneously seat against a vertical surface from which the apparatus is hung. The supporting edge has sufficient length to stabilize the apparatus in its storage position.

It is another object of the invention to afford a lightweight structure that can be simply constructed. In a preferred form, the handle is bent from a single piece of flexible, hollow tubing. The grip surrounds the free end of the handle remote from the head and has integral hanging structure.

BRIEF DESCRIPTION OF THE DRAWINGS

FIG. 1 is a perspective view of a preferred form of portable surface treating apparatus according to the invention shown in position to treat a surface under a conventional bus seat;

FIG. 2 is a side elevation view of the surface treating apparatus; and

FIG. 3 is a fragmentary elevation view of the surface treating apparatus in a hanging storage position against a vertical wall.

DETAILED DESCRIPTION OF THE DRAWINGS

In FIG. 1, a preferred form of surface treating apparatus is shown at 10 in one exemplary environment in which the apparatus 10 has utility. In FIG. 1, a portion of the interior of a bus is shown with seats 12, 14 in side-by-side relationship on opposite sides of an aisle 16. The seats 12, 14 are supported by a flat floor 18 over which a conventional runner 20 is placed in the aisle 16.

Each seat 12, 14 is substantially the same, and the detailed description herein will be limited to one exemplary seat 12. The seat 12 has a frame 22 for supporting horizontal and vertical seat cushions 24, 26 in elevated relationship with the floor 18. The frame 22 has laterally spaced, inverted U-shaped leg pairs 28 (one shown). Each leg pair 28 has a base 30 for supporting the cushions 24, 26 and spaced legs 32, 34 depending from the base 30. The legs 32, 34 have attached at their free ends enlarged flanges 36, 38, respectively, conventionally secured to the floor 18 so that the location of the seats 12, 14 is fixed.

Normally, the floor 18 is swept on a daily basis in commercial buses. The floor space 40 beneath the seats 12, 14 poses as a serious problem to maintenance personnel. Access thereto is obstructed by the framework 22 and the cushions 24, which normally are elevated on the order of one foot off of the surface of the floor 18. With conventional surface treating apparatus, such as mops and brooms, the user thereof must tilt the handle on the broom or mop to sweep a treating head thereon against the space 40 beneath the seat 12, 14. Not only is this uncomfortable for the user, but the handle tends to interfere with adjacent seats in the vicinity of that seat under which the surface is being treated. Further, particularly in the case of the use of a broom with bristles, the severe angle of the handle required to reach under the seats 12, 14, causes situation of the bristles at less than a preferred orientation. The present invention obviates these problems.

The inventive apparatus 10 consists of a head 42 having a hardwood block 44 with resilient, elongate bristles 46 attached thereto. It should be understood that while a broom head is disclosed, the invention contemplates other types of surface treating heads such as mops, sponges, and the like. An elongate handle 48 is attached to the head 42 to facilitate manipulation of the head from a location remote therefrom. The handle 48 is preferably formed from a tubular metal material and has a connecting end 50 and a gripping end 52.

A first straight section 54 adjacent the connecting end 50 has an elongated, substantially straight offset 56 which is conventionally attached to the block 44 on the head 42. The section 54 has a length on the order of one half the overall length of the handle 48. The angle $\alpha$ that the offset 56 makes with the first section 54 is chosen so that with the head in a preferred sweeping orientation relative to a flat surface 58 in FIG. 2, the straight section 54 is substantially horizontal, i.e. parallel to the surface 58.

A second straight section 60 is provided at the gripping end 52 of the handle 48 in line with the offset **5*b*, as shown in FIG. 2. The second section 60 is connected through a third straight section 62 to the first section 54**. An upwardly opening U-shaped bend is thus defined in the handle between its ends.

The angle $\theta$ between the first and third sections 54, 62 is preferably greater than 90° so that the entire section 54 can be directed under the seat 12 before the section 62 encounters the framework 22 and/or cushions 24, 26. As shown clearly in FIG. 1, if section 62 were made at an angle less than 90° with section 54, it would interfere with the cushion 24 in the position shown and thereby limit the sweeping stroke of the apparatus 10.

It should be understood that the lengths of and relative angles between the handle sections 54, 56, 60, 62 described are only exemplary. For example, the length of offset 56 determines the height of section 54 above the surface 58 to be cleaned. It is possible to eliminate the offset 56 altogether and have the section 54 connected directly to the head block 44. Further, the angle between sections 60 and 62 can be changed from that shown depending upon the desired attitude for the user's hand gripping the section 60. The angle between sections 60 and 62 is preferably greater than 90°.

What is important is that the head be capable of freely passing under an object under which a surface is to be cleaned with the handle capable of being gripped at a comfortable height and in a comfortable attitude. To realize this end, the handle sections need not be made straight i.e. they may be slightly curved.

To facilitate grasping of the handle and manipulation thereof, a resilient grip 64 surrounds the free end 66 of the section 60. The grip 64 has undercuts 68 such as those on a bicycle grip so that the user's hand readily conforms to the grip 64. The grip also has an integrally defined opening 70 into which a peg 72 or the like can be extended to hang the apparatus from a vertically extending surface 74 in a storage position shown in FIG. 3. The grip has a straight surface 76 substantially aligned with a supporting edge 78 on the head 42. With the apparatus 10 in the FIG. 3 storage position, the flat surface 76 on the grip 64 flushly seats against the surface 74 simultaneously as the supporting edge 78 abuts the surface 74. The supporting edge 78 has a substantial extent transverse to the length of the handle 48 and thus prevents rocking of the apparatus 10 from side to side in its storage position.

It should be understood that the foregoing description was made for purposes of demonstrating an exemplary structure according to the invention and its operation, and no unnecessary limitations should be understood therefrom.

I claim:

1. A portable surface treating apparatus comprising:

a head having means for treating a surface against which the head is swept with the head in a first orientation relative to a flat upwardly facing surface; and a handle formed from a tubular material to facilitate manipulation of said head from a location remote from said head, said handle having (a) a gripping end and a head connecting end, (b) means for connecting the connecting end of the handle to the head, (c) a substantially straight section adjacent the connecting end of the handle and having a second orientation with respect to said flat upwardly facing surface to be treated with said head in the first orientation, (d) a straight gripping section to be grasped by a user to facilitate manipulation of said head, and (e) means interconnecting the straight section adjacent the connecting end and gripping section so that the gripping section is above the line of the straight handle section adjacent the connecting end with the straight handle section adjacent the connecting end in said second orientation relative to a flat upwardly facing surface to be treated, said straight section having an elongate straight offset, said connecting means connects the offset to the head, and the length of the offset is in line with the straight gripping section and angularly offset from the line of the straight section adjacent the connecting end.

2. The portable surface treating apparatus according to claim 1 wherein there is a grip on said gripping section to be grasped by the hand of a user, means are provided on the gripping section for hanging the surface treating apparatus in a storage position against a vertically extending surface, said head has an elongate supporting edge and the grip has a straight surface in the plane of said head supporting edge so that the straight surface on the grip and head supporting edge simultaneously bear on a vertical wall with the surface treating apparatus in the storage position.

* * * * *